US005640899A

United States Patent [19]

Bell et al.

[11] Patent Number: 5,640,899

[45] Date of Patent: Jun. 24, 1997

[54] STRAP SEVERING AND EJECTING APPARATUS AND METHOD FOR STRAPPING MACHINE

[75] Inventors: Lem Bell, Zion; Tim Pearson, Antioch, both of Ill.

[73] Assignee: Illinois Tool Works Inc., Glenview, Ill.

[21] Appl. No.: 573,326

[22] Filed: Dec. 15, 1995

[51] Int. Cl.[6] ..... B65B 13/02

[52] U.S. Cl. ..... 100/2; 53/589; 100/26; 100/32; 226/25

[58] Field of Search ..... 100/8, 26, 29, 100/32, 33 PB, 2; 53/589; 226/25

[56] References Cited

U.S. PATENT DOCUMENTS

| | | | |
|---|---|---|---|
| 4,145,963 | 3/1979 | Leslie et al. | 100/26 |
| 4,683,017 | 7/1987 | Figiel et al. | 100/2 |
| 5,287,802 | 2/1994 | Pearson | 100/26 |

FOREIGN PATENT DOCUMENTS

| | | | |
|---|---|---|---|
| 1-70318 | 3/1989 | Japan | 100/8 |
| 1-213109 | 8/1989 | Japan | 100/26 |
| 6-247408 | 9/1994 | Japan | 100/8 |
| 951295 | 3/1964 | United Kingdom | 100/2 |

*Primary Examiner*—Stephen F. Gerrity
*Attorney, Agent, or Firm*—Schwartz & Weinrieb

[57] ABSTRACT

An automatic strap severing and ejecting apparatus and method for a strapping machine is provided. The strap severing device of the present invention cooperates with the tensioning and feed wheels, allowing the tensioning and feed wheels to serve a dual function, one function during normal operation and a second function during automatic severing and ejecting of strap error from the strapping machine.

18 Claims, 2 Drawing Sheets

STRAP SEVERING AND EJECTING APPARATUS AND METHOD FOR STRAPPING MACHINE

BACKGROUND OF THE INVENTION

1. Field of the Invention

The present invention relates to strap severing and ejecting apparatus and methods for strapping machines. In particular, the invention relates to a device which automatically severs and ejects strap errors from the strapping machine.

2. Description of Related Art

In the past, severing and ejecting strap errors from a strapping machine involved complex components which were not completely integrated into the entire strapping machine by virtue of their separate functions. For example, related prior art U.S. Pat. No. 5,287,802 requires a separate feeding and tensioning apparatus to automatically sever and eject strap errors. Provision of separate components with dedicated duty related specifically to severing and rejecting strap errors leads to problems of additional mechanical complexity and the related maintenance disadvantages, additional electronic control systems, and consequent higher cost.

These and other related problems are solved by the invention disclosed herein.

SUMMARY OF THE INVENTION

The present invention embodies many advantages over prior art systems for severing and ejecting strap errors in a strapping machine.

One object of the present invention is to provide for the automatic severing and ejecting of strap errors from a strapping machine.

Another object is to achieve the severing and ejecting of strap errors utilizing a system which is integral with the other standard functions of a strapping machine.

A further object of the invention is to use the strap feeding means and the strap tensioning means to also eject strap errors from the strapping machine.

These and other objects of the invention are achieved by the present invention.

BRIEF DESCRIPTION OF THE DRAWINGS

Various others, features, and attendant advantage of the present invention will be more fully appreciated from the following detailed description when considered in conjunction with the accompanying drawings in which like reference characters designate like or corresponding parts throughout the several views, and wherein:.

DESCRIPTION OF THE PREFERRED EMBODIMENT

Figure 1:
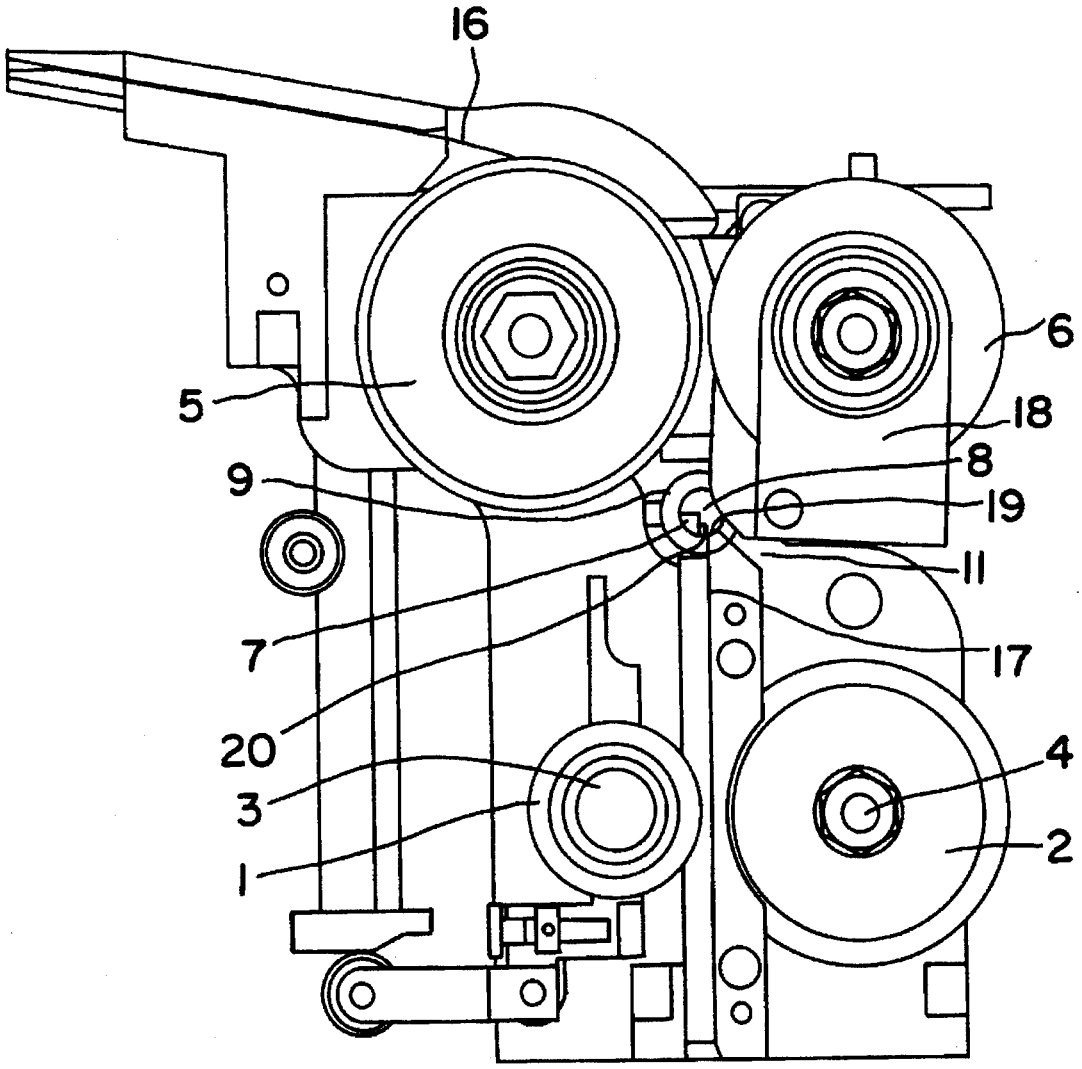
FIG. 1 is a front view of the present invention.
Figure 2:
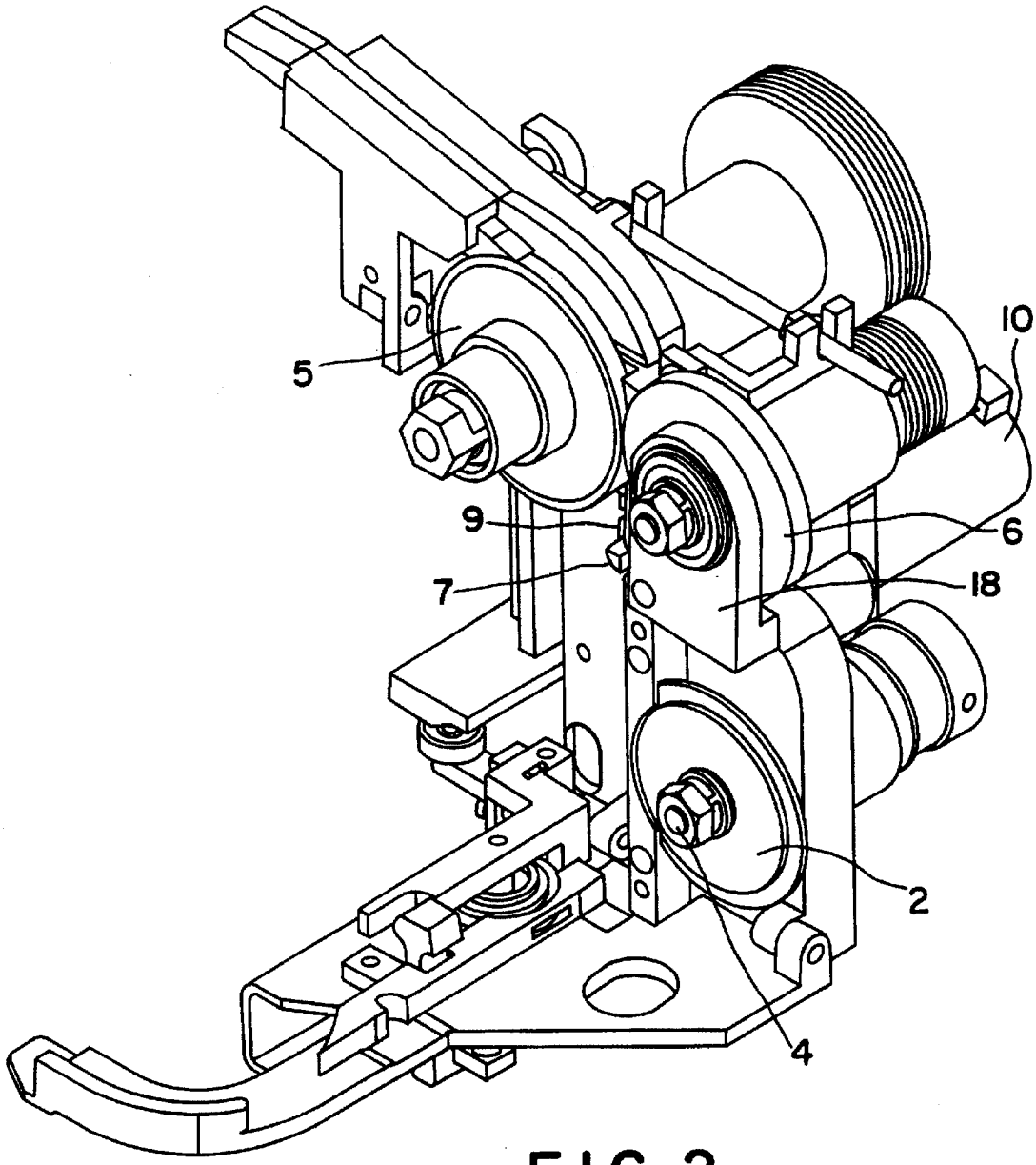
FIG. 2 is a top right perspective view of the present invention.

Referring to FIG. 1, the strap severing and ejecting apparatus of the present invention provides a strap cutter element 7 located between a first and second tension wheel set 5, 6, and a first and second feed wheel set 1, 2. The strap cutter element 7 rotates about a strap cutter axis 8 and may be disposed within a strap cutter sleeve 9. During normal operation of the strapping machine, the strap 16 passes undisturbed along an edge of the strap cutter element 7 through normal path 17. However, in the event of a strap error downstream of the tension wheels 5,6, the strap cutter element 7 rotates in a direction which positions a strap segment between a rotating cutting surface 20 of the strap cutter element 7 and a fixed cutting surface 19. Continued rotation of the strap cutter element 7 severs the strap 16 at that point, and also directs the downstream portion of the severed strap 16, including the strap error, into an ejection path 11, while at the same time blocking the normal path 17. A pivotable strap guide 18 which may be disposed about second tension wheel 6 is rotated so as to open a clear ejection path for ejection of the strap error segment. The pivotable strap guide 18 may be spring loaded.

The same first and second tension wheels 5, 6 which are utilized during normal operation of the strapping device are now operated to convey the strap 16 including the strap error out of the strapping machine for disposal or recycling. A gear motor 10 may be utilized to rotate the strap cutter element 7 between the normal position and the cutting/ejection position. A linkage may be provided for use in connection with the gear motor 10 to limit the angular displacement of the rotating strap cutter element 7.

After the strap error has been completely ejected from the strapping machine, the first and second feed wheels 1,2 refeed the strap 16 through the normal path 17, past the strap cutter element 7 which has been returned to its normal operation position, and up through the chute for the next strapping job.

In this manner, the first and second feed wheels 1, 2, and the first and second tension wheels 5, 6, serve dual functions, one function during normal strapping conditions, and a second function during the automatic strap ejection procedure. The dual function of the feed and tension wheels 5,6 allows for a simplification and reduction of the total elements necessary for the strapping machine to carry out the required functions. This leads to cost reductions, maintenance simplification, and reliability increases over prior art strapping machines.

The invention described above also encompasses the range of equivalents to which it is entitled, and is only limited by the following claims.

I claim:

1. An automatic strap severing and ejecting apparatus for a strapping machine, comprising:

strap feeding means for feeding a strap along a normal strap travel path during normal operation of said machine;

strap tensioning means cooperating with said strap feeding means for tensioning said strap fed along said normal strap travel path by said strap feeding means during said normal operation of said machine; and strap cutting means interposed between said strap tensioning means and said strap feeding means and disposed along said normal strap travel path so as to be unobtrusive to strap travel during normal operation of said machine but being operable to sever a strap, and direct a downstream section of the severed strap toward an ejection path when a strap malfunction occurs;

said strap tensioning means also being operable during said strap malfunction occurrence so as to convey said downstream section of said severed strap along said ejection path and eject said downstream section of said severed strap out of said machine.

2. An automatic strap severing and ejecting apparatus for a strapping machine as claimed in claim 1, wherein said strap cutting means comprises:

a rotatable strap cutter element having a rotating cutting surface located along an edge of said rotatable strap cutter element; and a fixed cutting surface separate from and disposed adjacent to said rotating cutting surface such that a strap segment to be severed is disposed between said rotating cutting surface and said fixed cutting surface wherein rotation of said rotatable strap cutter element through a cutting cycle causes said rotating cutting surface of said rotatable strap cutter element to be disposed against said strap segment to be severed and then moves said rotating cutting surface of said rotatable strap cutter element through said strap and toward said fixed cutting surface until said strap is severed.

3. An automatic strap severing and ejecting apparatus for a strapping machine as claimed in claim 2, wherein:

said strap tensioning means comprises first and second tension wheels;

said strap feeding means comprises first and second feed wheels; and said rotatable strap cutter element is disposed between said first and second tension wheels and said first and second feed wheels the first and second tension wheels being rotatable to withdraw a segment of strap from the strapping machine and deliver the segment of strap to the ejector path and ultimately out of the strapping machine, wherein the first and second tension wheels serve the dual function of tensioning the strap during normal operation and ejection the strap segment from the strapping machine in the event of a strap error.

4. An automatic strap severing and ejecting apparatus for a strapping machine as claimed in claim 3, further comprising:

a pivotable strap guide disposed adjacent to said second tension wheel so as to be pivotable away from said normal strap travel path during a strap malfunction severing and ejection cycle wherein rotation of said pivotable strap guide away from said normal strap travel path opens said ejection path to said severed strap segment to be ejected.

5. An automatic strap severing and ejecting apparatus for a strapping machine as claimed in claim 4, wherein the pivotable strap guide is spring loaded.

6. An automatic strap severing and ejecting apparatus for a strapping machine as claimed in claim 5, further comprising a gear motor which rotates the strap cutter element through its range of rotation.

7. An automatic strap severing and ejecting apparatus for a strapping machine as claimed in claim 6, further comprising a strap cutter sleeve which houses the strap cutter element, the strap cutter sleeve being stationary.

8. An automatic strap severing and ejecting apparatus for a strapping machine as claimed in claim 4, further comprising:

means for driving said first and second feed wheels so as to refeed said strap into said strapping machine after completion of said strap segment ejection cycle.

9. An automatic strap severing and ejecting apparatus for a strapping machine, comprising:

strap feeding means for feeding a strap along a normal strap travel path during normal operation of said machine;

strap cutting means disposed along said normal strap travel path so as to be unobtrusive to strap travel during normal operation of said machine but being operable to sever a strap and direct a downstream section of said severed strap toward an ejection path when a strap malfunction occurs; and dual-function strap tensioning means for tensioning said strap fed along said normal strap travel path by said strap feeding means during said normal operation of said machine, and for conveying said downstream section of said severed strap along said ejection path for ejection of said downstream section of said severed strap out of said machine following said strap malfunction occurrence.

10. Apparatus as set forth in claim 9, wherein:

said strap cutting means is interposed between said strap feeding means and said strap tensioning means.

11. Apparatus as set forth in claim 9, wherein said strap cutting means comprises:

a rotatable strap cutter element having a rotating cutting surface located along an edge of said rotatable strap cutter element; and a fixed cutting surface separate from and disposed adjacent to said rotating cutting surface such that a strap segment to be severed is disposed between said rotating cutting surface and said fixed cutting surface wherein rotation of said rotatable strap cutter element through a cutting cycle causes said rotating cutting surface of said rotatable strap cutter element to be disposed against said strap segment to be severed and then moves said rotating cutting surface of said rotatable strap cutter element through said strap and toward said fixed cutting surface until said strap is severed.

12. Apparatus as set forth in claim 11, wherein:

said strap tensioning means comprises a pair of tension wheels;

said strap feeding means comprises a pair of feed wheels; and said rotatable strap cutter element is interposed between said feed wheels and said tension wheels.

13. Apparatus as set forth in claim 12, further comprising:

a pivotable strap guide disposed adjacent to said tension wheels so to be pivotable away from said normal strap travel path during a strap malfunction severing and ejection cycle wherein rotation of said pivotable strap guide away from said normal strap travel path opens said ejection path to said severed strap segment to be ejected from said machine.

14. A method of operating a strapping machine during normal operation and malfunction cycles, comprising the steps of:

providing strap feeding means for feeding a strap along a normal strap travel path during a normal operation cycle of said machine;

providing strap tensioning means for tensioning said strap fed along said normal strap travel path by said strap feeding means during said normal operation cycle of said machine;

providing strap cutting means disposed along said normal strap travel path so as to be movable between a first position at which said strap cutting means is unobtrusive to travel of said strap along said normal strap travel path during said normal operation cycle of said machine, and a second position at which said strap cutting means severs said strap when a strap malfunction occurs and directs a downstream section of said severed strap toward an ejection path during a strap malfunction operation cycle;

operating said strap feeding means and said strap tensioning means, while said strap cutting means is disposed at said first position, so as to convey said strap along said normal strap travel path during a normal operation cycle of said machine;

moving said strap cutting means from said first position to said second position when a strap malfunction occurs so as to sever said strap and direct a downstream section of said severed strap toward said ejection path; and operating said strap tensioning means for conveying said downstream section of said severed strap along said ejection path for ejection of said downstream section of said severed strap out of said machine during a strap malfunction operation cycle.

15. The method as set forth in claim 14, further comprising the steps of:

providing first and second feed wheels so as to comprise said strap feeding means;

providing first and second tension wheels so as to comprise said strap tensioning means; and interposing said strap cutting means between said first and second feed wheels and said first and second tension wheels.

16. The method as set forth in claim 14, further comprising the step of:

interposing said strap cutting means between said strap feeding means and said strap tensioning means.

17. The method as set forth in claim 14, further comprising the steps of:

providing said strap cutting means as a rotatable strap cutting element; and rotating said rotatable strap cutting element between said first and second positions when said machine is being operated during said normal operation and strap malfunction operation cycles, respectively.

18. The method as set forth in claim 14, further comprising the step of:

providing a pivotable strap guide in conjunction with said strap tensioning means; and pivoting said pivotable strap guide away from said normal strap travel path during said strap malfunction operation cycle so as to uncover said ejection path and thereby permit said downstream section of said severed strap to be conveyed along said ejection path and ejected out from said machine.

* * * * *